US006026361A

United States Patent [19]

Hura

[11] Patent Number: 6,026,361

[45] **Date of Patent: *Feb. 15, 2000**

[54] SPEECH INTELLIGIBILITY TESTING SYSTEM

[75] Inventor: Susan L. Hura, Morganville, N.J.

[73] Assignee: Lucent Technologies, Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/204,461

[22] Filed: Dec. 3, 1998

[51] Int. Cl.[7] ..... G10L 3/00; G10L 3/02; G10L 9/00

[52] U.S. Cl. ..... 704/270; 704/271; 704/200; 704/201

[58] Field of Search ..... 704/270, 271, 704/200, 201

[56] References Cited

PUBLICATIONS

Gilhooly, K.J. and Logie, R.H. (1980) Meaning–Dependent Ratings of Imagery, Age–of–Acquisition, Familiarity and Concreteness for 387 Ambiguous Words, *Behavior Research Methods and Instrumentation 12*, p. 428–450.

Ganong, W. (1980), Phonetic Categorization in Auditory Word Perception, *Journal of Experimental Psychology: Human Perception and Performance 6*, p. 110–125.

Zechmeister, E.G., King, J., Gude, C. and Opera–Nadi, B. (1975), Ratings of Frequency, Familiarity, Orthographic Distinctiveness and Pronuncibility for 192 Surnames, *Behavior Research Methods and Instrumentation 7*, p. 531–533.

Newbigging, P.L. (1961), The Percetual Reintegration of Frequent and Infrequent Words, *Canadian Journal of Psychology 15*, p. 123–132.

Soloman, R.L. and Postman, L., Frequency of Usage as a Determinant of Recognition Thresholds for Words, *Journal of Experimental Psychology 43*p. 195–201.

Coltheart, M. (1981) The MRC Psycholinguistic Database, *Quarterly Journal of Experimental Psychology: Human Experimental Psychology 33A*, p. 497–505.

Whalen, D.H., Zsiga, E.C., (1994) Subjective Familiarity of English Word/Name Homophones, *Behavior Reserch Methods, Instruments and Computers 26*, p. 402–408.

Howes, D.H. (1957) On the Relation between the Intelligibility and Frequency of Ocurence of English Words, *Journal of the Acoustical Society of America 29*, p. 296–305.

Savin, H.B. (1963) Word Frequency Effect and Errors in the Perception of Speech, *Journal of the Acoustical Society of America 35*, p. 200–206.

Halle, M. and Vergnaud, J. (1987) An Essay on Stress, *Cureent Studies in Linguistics 15, Cambridge MA, MIT Press*.

(List continued on next page.)

*Primary Examiner*—David R. Hudspeth
*Assistant Examiner*—Robert Louis Sax

[57] ABSTRACT

The present invention, according to one embodiment, comprises a speech intelligibility testing system and method. The invention comprises a sound device for producing a plurality of stimulus words to be heard by a test subject and a display 11q11qqqqqqqqq1means configured to display a set of word pairs corresponding to a set of contrasting speech sounds. Each word pair comprises two words which are real words with a high degree of familiarity to the test subject, and are displayed whenever a stimulus word is transmitted to the test subject. The first word of the word pair corresponds to the stimulus word, while the second word differs from the first word by at least one of the set of contrasting speech sounds. The invention also comprises a means for the test subject to select one word of the word pair after deciding which of the two words was heard. In accordance with one embodiment, the present invention employs a set of rules to generate vowel and consonant contrasts to be tested. In accordance with another embodiment, each word consists of three speech sounds, and the intelligibility test of the present invention is employed to test the contrasting speech sounds in either or all of a first consonant, a second vowel and third consonant speech sounds of the words.

47 Claims, 14 Drawing Sheets

OTHER PUBLICATIONS

Voiers, W. (1977) Evaluating Processed Speech Using Diagnostic Rhyme Test, *Speech Technology Jan./Feb.*, p. 30–39.
van Santen, J.P. (1993) Perceptual Experiments for Diagnostic Testing of Text–to–Speech Systems, *Computer Speech and Language 7*, p. 49–100.
Toglia, M.P. and Battig, W.F. (1978) Handbook of Sematic Word Norms, Hillsdale N.J., Erlbaum.
Kucera, H. and Francis, W. (1967) Computational Analysis of Present–Day American English, Providence, R.I. *Brown University Press*.
Paivio, A.V., Yuille, J.C. and Madigan, S.A. (1968) Concrete Imagery and Meaningfulness Values for 925 Nouns, *Journal of Experimental Psychology Monograph 76* (*3, Part 2*) .
Kenstowicz, M. Kisseberth, C. (1979) Generative Phonology, New York, Academic Press.
Jakobsob, R., Fant, G., Halle, M. (1952) Preliminaries to Speech Analysis, Cambridge, MA. MIT Press.
Chomsky, N. and Halle, M. (1968) The Sound Pattern of English, New Yorker, Harper Row.
Osherton, D. and Lasnik, H., *Language, vol. 1;* Cambridge MA, MIT Press.

*FIG. 2A*

| | BILABIAL | LABIODENTAL | DENTAL | ALVEOLAR | POSTALVEOLER | RETROFLEX | PALATAL | VELAR | UVULAR | PHARYNGEAL | GLOTTAL |
|---|---|---|---|---|---|---|---|---|---|---|---|
| PLOSIVE | p b | | t d | | | ʈ ɖ | c ɟ | k g | q G | | ʔ |
| NASAL | m | ɱ | n | | | ɳ | ɲ | ŋ | N | | |
| TRILL | B | | r | | | | | | R | | |
| TAP OR FLAP | | | ɾ | | | ɽ | | | | | |
| FRICATIVE | ɸ β | f v | θ ð | s z | ʃ ʒ | ʂ ʐ | ç ʝ | x ɣ | χ ʁ | ħ ʕ | h ɦ |
| LATERAL FRICATIVE | | | ɬ ɮ | | | | | | | | |
| APPROXIMANT | | ʋ | ɹ | | | ɻ | j | ɰ | | | |
| LATERAL APPROXIMANT | | | l | | | ɭ | ʎ | L | | | |

| MANNER OF ARTICULATION \ PLACE OF ARTICULATION | BILABIAL | LABIO-DENTAL | DENTAL | ALVELOAR | PALATO-ALVEOLAR | PALATAL | VELAR |
|---|---|---|---|---|---|---|---|
| NASAL (STOP) | m | | | n | | | ŋ |
| STOP | p b | | | t d | | | k g |
| FRICATIVE | | f v | θ ð | s z | ʃ ʒ | | |
| (CENTRAL) APPROXIMANT | (w) | | | ɹ | | j | w |
| LATERAL (APPROXIMANT) | | | | l | | | |

*FIG. 4A*

| | | | |
|---|---|---|---|
| p | pie | pea | |
| t | tie | tea | |
| k | kye | key | |
| b | by | bee | |
| d | dye | D | |
| g | guy | | |
| m | my | me | ra *m* |
| n | nigh | knee | ra *n* |
| ŋ | | | ra *ng* |
| f | fie | fee | |
| v | vie | V | |
| θ | thigh | | |
| ð | thy | thee | |
| s | sigh | sea | listen |
| z | | Z | mi *zz*en |
| ʃ(š) | shy | she | mission |
| ʒ(ž) | | | vision |
| l | lie | lee | |
| w | why | we | |
| ɹ(r) | rye | | |
| j(y) | | ye | |
| h | high | he | |
| Note also the following: | | | |
| tʃ(č) | chi(me) | chea(p) | |
| dʒ(ǰ) | ji(ve) | G | |

*FIG. 4B*

| 1 | 2 | | | | | |
|---|---|---|---|---|---|---|
| i | i | heed | he | bead | heat | keyed |
| ɪ | ɪ | hid | | bid | hit | kid |
| eɪ | eɪ | hayed | hay | bayed | hate | Cade |
| ɛ | ɛ | head | | bed | | |
| æ | æ | had | | bad | hat | cad |
| *a*ɹ | *a* | hard | | bard | heart | card |
| *a* | *ɒ* | hod | | bod | hot | cod |
| ɔ | ɔ | hawed | haw | bawd | | cawed |
| ʊ | ʊ | hood | | | | could |
| oʊ | əʊ | hoed | hoe | bode | | code |
| u | u | who'd | who | booed | hoot | cooed |
| ʌ | ʌ | Hudd | | bud | hut | cud |
| ɜ | ɜ | herd | her | bird | hurt | curd |
| aɪ | aɪ | hide | high | bide | height | |
| aʊ | aʊ | | how | howed | | cowed |
| ɔɪ | ɔɪ | | (a)hoy | Boyd | | |
| ɪɹ | ɪə | | here | beard | | |
| eɹ | ɛə | | hair | bared | | cared |
| aɪɹ | aə | hired | hire | | | |
| note also | | | | | | |
| ju | ju | hued | hue | Bude | | cued |

*FIG. 5A*

| FEATURE NAME | CLASSIFICATORY POSSIBILITIES | ENGLISH SEGMENTS |
|---|---|---|
| VOICE | [+VOICE] | b,d,g,m,n,v,ð,z,ʒ,ɹ,l,j (and all vowels) |
| | [−VOICE] | p,t,k,f,θ,s,ʃ |
| LABIAL | – | p,b,m,f,v |
| CORONAL | [+ANTERIOR] | θ,ð,t,d,n,s,z,l,ɹ |
| | [−ANTERIOR] | ʃ,ʒ,j (and front vowels) |
| DORSAL | – | k,g,w (and back vowels) |
| STRICTURE | [STOP] | p,t,k,b,d,g,m,n |
| | [FRICATIVE] | f,θ,s,ʃ,v,ð,z,ʒ |
| | [APPROXIMANT] | w,ɹ,l,j (and all vowels) |
| NASAL | [+NASAL] | m,n, |
| | [−NASAL] | (all other segments) |
| LATERAL | [+LATERAL] | l |
| | [−LATERAL] | (all other segments) |
| SIBILANT | [+SIBILANT] | s,ʃ,z,ʒ,(and č, ǰ) |
| | [−SIBILANT] | (all other segments) |
| HEIGHT | [MAXIMUM] | (all consonants except w, j) |
| | [4 HEIGHT] | i,u,w,j |
| | [3 HEIGHT] | e,ɪ,o,ʊ |
| | [2 HEIGHT] | ɛ,ɔ |
| | [1 HEIGHT] | æ, *a* |
| BACK | [+BACK] | u,o,ʊ,ɔ,w, k, g |
| | [−BACK] | i,e,ɪ,ɛ,æ(and all other consonants) |
| SYLLABIC | [+SYLLABIC] | (all vowels) |
| | [−SYLLABIC] | (all consonants, including w, j) |

*FIG. 5B*

FEATURE MATRIX FOR ENGLISH VOWELS

| | | i | ɪ | eɪ | ɛ | æ | ʌ | ə | ɑ | u | ʊ | ɔr | ɔ |
|---|---|---|---|---|---|---|---|---|---|---|---|---|---|
| MAJOR CLASS FEATURES | [CONSONANTAL] | − | − | − | − | − | − | − | − | − | − | − | − |
| | [SONORANT] | + | + | + | + | + | + | + | + | + | + | + | + |
| | [SYLLABIC] | + | + | + | + | + | + | + | + | + | + | + | + |
| LARYNGEAL FEATURES | [VOICE] | + | + | + | + | + | + | + | + | + | + | + | + |
| PLACE FEATURES | [ROUND] | − | − | − | − | − | − | − | − | + | + | + | + |
| DORSAL FEATURES | [HIGH] | + | + | − | − | − | − | − | − | + | + | − | − |
| | [LOW] | − | − | − | − | + | − | − | + | − | − | − | − |
| | [BACK] | − | − | − | − | − | + | + | + | + | + | + | + |
| | [TENSE] | + | − | + | − | − | − | − | + | + | − | + | − |
| | [REDUCED] | − | − | − | − | − | − | + | − | − | − | − | − |
| MANNER FEATURE | [CONTINUANT] | + | + | + | + | + | + | + | + | + | + | + | + |

*FIG. 6A*

| CONTRAST | INITIAL POSITION | | | | FINAL POSITION | | | |
|---|---|---|---|---|---|---|---|---|
| | ITEM 1 | TRANSCRIPTION | ITEM 2 | TRASNCRIPTION | ITEM 1 | TRANSCRIPTION | ITEM 2 | TRASNCRIPTION |
| [p/t] | peach | [pitʃ] | teach | [titʃ] | type | [taɪp] | tight | [taɪt] |
| [p/k] | pave | [peɪv] | cave | [keɪv] | shop | [ʃap] | shock | [ʃak] |
| [p/b] | pad | [pæd] | bad | [bæd] | lap | [læp] | lab | [læb] |
| [p/m] | paid | [peɪd] | maid | [meɪd] | hope | [hoʊp] | home | [hoʊm] |
| [p/f] | pays | [peɪz] | phase | [feɪz] | wipe | [waɪp] | wife | [waɪf] |
| [t/k] | take | [teɪk] | cake | [keɪk] | seat | [sit] | seek | [sik] |
| [t/d] | tuck | [tək] | duck | [dək] | fate | [feɪt] | fade | [feɪd] |
| [t/n] | toes | [toʊz] | nose | [noʊz] | fit | [fɪt] | fin | [fɪn] |
| [t/s] | tag | [tæg] | sag | [sæg] | kit | [kɪt] | kiss | [kɪs] |
| [t/θ] | tick | [tɪk] | thick | [θɪk] | boot | [but] | booth | [buθ] |
| [t/tʃ] | top | [tap] | chop | [tʃap] | pout | [paʊt] | pouch | [paʊt]ʃ |
| [k/g] | cash | [kæʃ] | gash | [gæʃ] | pick | [pɪk] | pig | [pɪg] |
| [k/ŋ] | X | | X | | sick | [sɪk] | sing | [sɪŋ] |
| [k/ʃ] | keep | [kip] | sheep | [ʃip] | walk | [wak] | wash | [waʃ] |
| [b/d] | buys | [baɪz] | dies | [daɪz] | sob | [sab] | sod | [sad] |
| [b/g] | boat | [boʊt] | goat | [goʊt] | job | [dʒab] | jog | [dʒag] |
| [b/m] | bake | [beɪk] | make | [meɪk] | tube | [tub] | tomb | [tum] |
| [b/v] | bet | [bɛt] | vet | [vɛt] | dub | [dəb] | dove | [dəv] |
| ⋮ | ⋮ | ⋮ | ⋮ | ⋮ | ⋮ | ⋮ | ⋮ | ⋮ |

*FIG. 6A* (CONTINUED)

| | | | | | | | | |
|---|---|---|---|---|---|---|---|---|
| ⋮ | ⋮ | ⋮ | ⋮ | ⋮ | ⋮ | ⋮ | ⋮ | ⋮ |
| [d/g] | daze | [deɪz] | gaze | [geɪz] | did | [dɪd] | dig | [dɪg] |
| [d/n] | deed | [did] | need | [nid] | dude | [dud] | dune | [dun] |
| [d/z] | doom | [dum] | zoom | [zum] | pawed | [pɔd] | pause | [pɔz] |
| [d/ð] | doze | [doʊz] | those | [ðoʊz] | bade | [beɪd] | bathe | [beɪð] |
| [d/dʒ] | debt | [dɛt] | jet | [dʒɛt] | head | [hɛd] | hedge | [hɛdʒ] |
| [g/ŋ] | X | | X | | rag | [ɹæg] | rang | [ɹæŋ] |
| [g/ʒ] | X | | X | | ? | | ? | |
| [f/θ] | fought | [fɔt] | thought | [θɔt] | deaf | [dɛf] | death | [dɛθ] |
| [f/s] | food | [fud] | sued | [sud] | buff | [bəf] | bus | [bəs] |
| [f/ʃ] | feet | [fit] | sheet | [ʃit] | rough | [ɹəf] | rush | [ɹəʃ] |
| [f/h] | fill | [fɪl] | hill | [hɪl] | X | | X | |
| [f/v] | fan | [fæn] | van | [væn] | leaf | [lif] | leave | [liv] |
| [f/m] | fast | [fæst] | mast | [mæst] | thief | [θif] | theme | [θim] |
| [θ/s] | thighs | [θaɪz] | size | [saɪz] | path | [pæθ] | pass | [pæs] |
| [θ/ʃ] | thin | [θin] | shin | [ʃin] | with | [wɪθ] | wish | [wɪʃ] |
| [θ/h] | third | [θɚd] | heard | [hɚd] | X | | X | |
| [θ/ð] | ? | | ? | | teeth | [tiθ] | teethe | [tið] |
| [θ/n] | thumb | [θəm] | numb | [nəm] | both | [boʊθ] | bone | [boʊn] |
| ⋮ | ⋮ | ⋮ | ⋮ | ⋮ | ⋮ | ⋮ | ⋮ | ⋮ |

*FIG. 6A* (CONTINUED)

| | | | | | | | | |
|---|---|---|---|---|---|---|---|---|
| ⋮ | ⋮ | ⋮ | ⋮ | ⋮ | ⋮ | ⋮ | ⋮ | ⋮ |
| [s/ʃ] | sift | [sɪft] | shift | [ʃɪft] | mess | [mɛs] | mesh | [mɛʃ] |
| [s/h] | such | [sətʃ] | hutch | [hətʃ] | X | | X | |
| [s/z] | sip | [sɪp] | zip | [zɪp] | hiss | [hɪs] | his | [hɪz] |
| [s/n] | sight | [saɪt] | night | [naɪt] | vice | [vaɪs] | vine | [vaɪn] |
| [ʃ/h] | share | [ʃeɪɹ] | hair | [heɪɹ] | X | | X | |
| [ʃ/ŋ] | X | | X | | bash | [bæʃ] | bang | [bæŋ] |
| [ʃ/ʒ] | X | | X | | ? | | ? | |
| [ʃ/tʃ] | ship | [ʃɪp] | chip | [tʃɪp] | mash | [mæʃ] | match | [mætʃ] |
| [v/ð] | vat | [væt] | that | [ðæt] | live | [laɪv] | lithe | [laɪð] |
| [v/z] | veal | [vil] | zeal | [zil] | have | [hæv] | has | [hæs] |
| [v/ʒ] | X | | X | | ? | | ? | |
| [v/m] | veil | [veɪl] | mail | [meɪl] | cove | [koʊv] | comb | [koʊm] |
| [ð/z] | then | [ðɛn] | zen | [zɛn] | lathe | [leɪð] | lays | [leɪz] |
| [ð/ʒ] | X | | X | | ? | | ? | |
| [ð/n] | these | [ðiz] | knees | [niz] | soothe | [suð] | soon | [sun] |
| ⋮ | ⋮ | ⋮ | ⋮ | ⋮ | ⋮ | ⋮ | ⋮ | ⋮ |

*FIG. 6A* (CONTINUED)

| ⋮ | ⋮ | ⋮ | ⋮ | ⋮ | ⋮ | ⋮ | ⋮ | ⋮ |
|---|---|---|---|---|---|---|---|---|
| [z/ʒ] | X | | X | | lose | [luz] | luge | [luʒ] |
| [z/v] | zoos | [zuz] | news | [nuz] | tease | [tiz] | teen | [tin] |
| [ʒ/ŋ] | X | | X | | ? | | ? | |
| [ʒ/dʒ] | X | | X | | ? | | ? | |
| [m/n] | mood | [mud] | nude | [nud] | term | [tɝm] | turn | [tɝŋ] |
| [m/ŋ] | X | | X | | some | [səm] | sung | [səŋ] |
| [n/ŋ] | X | | X | | win | [wɪn] | wing | [wɪŋ] |
| [ɹ /l] | rash | [ɹæʃ] | lash | [læʃ] | tire | [taɪɹ] | tile | [taɪɹ] |
| [ɹ /w] | rest | [ɹɛst] | west | [wɛst] | X | | X | |
| [ɹ /j] | rack | [ɹæk] | yak | [jæk] | X | | X | |
| [l/w] | let | [lɛt] | wet | [wɛt] | X | | X | |
| [l/j] | luck | [lək] | yuck | [jək] | X | | X | |
| [w/j] | woke | [woʊk] | yoke | [joʊk] | X | | X | |
| [tʃ/dʒ] | cheer | [tʃiɹ] | jeer | [dʒiɹ] | perch | [pɝtʃ] | purge | [pɝdʒ] |

*FIG. 6B*

| CONTRAST | ITEM 1 | TRANSCRIPTION | ITEM 2 | TRANSCRIPTION |
|---|---|---|---|---|
| [i/ɪ] | bead | [bid] | bid | [bɪd] |
| [i/u] | seep | [sip] | soup | [sup] |
| [i/eɪ] | peace | [pis] | pace | [peɪs] |
| [i/ɛ] | neat | [nit] | net | [nɛt] |
| [i/æ] | beak | [bik] | back | [bæk] |
| [ɪ/ʊ] | pit | [pɪt] | put | [pʊt] |
| [ɪ/ə] | mist | [mɪst] | must | [məst] |
| [ɪ/eɪ] | give | [gɪv] | gave | [geɪv] |
| [ɪ/ɛ] | sit | [sɪt] | set | [sɛt] |
| [ɪ/æ] | lift | [lɪft] | laughed | [læft] |
| [eɪ/ɛ] | rake | [ɹeɪk] | wreck | [ɹɛk] |
| [eɪ/oʊ] | cape | [keɪp] | cope | [koʊp] |
| [eɪ/æ] | lake | [leɪk] | lack | [læk] |
| [ɛ/ɔ] | well | [wɛl] | wall | [wɔl] |
| [ɛ/ə] | beg | [bɛg] | bug | [bəg] |
| [ɛ/æ] | guess | [gɛs] | gas | [gæs] |
| [æ/ɑ] | cab | [kæb] | cob | [kɑb] |
| [æ/ə] | cat | [kæt] | cut | [kət] |
| [ɑ/ə] | shot | [ʃɑt] | shut | [ʃət] |
| [ɔ/ɑ] | caught | [kɔt] | cot | [kɑt] |
| [ɔ/ə] | bought | [bɔt] | but | [bət] |
| [oʊ/ɔ] | note | [noʊt] | naught | [nɔt] |
| [oʊ/ɑ] | soak | [soʊk] | sock | [sɑk] |
| [ʊ/ə] | book | [bʊk] | buck | [bək] |
| [ʊ/oʊ] | cook | [kʊk] | coke | [koʊk] |
| [ʊ/ɔ] | could | [kʊd] | cawed | [kɔd] |
| [ʊ/ɑ] | push | [pʊʃ] | posh | [pɑʃ] |
| [u/ʊ] | pull | [pʊl] | pool | [pul] |
| [u/oʊ] | ruse | [ɹuz] | rose | [ɹoʊz] |
| [u/ɔ] | suit | [sut] | sought | [sɔt] |
| [u/ɑ] | duke | [duk] | dock | [dɑk] |

SPEECH INTELLIGIBILITY TESTING SYSTEM

FIELD OF THE INVENTION

This invention relates to a system and method for testing speech intelligibility and more specifically to a speech intelligibility testing system that tests a specific set of contrasting speech sounds by employing, according to one embodiment, a two-item forced choice test format.

BACKGROUND OF THE INVENTION

Testing the intelligibility of speech via telephony is an important aspect of the communications industry, since one of the primary goals of a speech communications system is to enable a speech message to be understood and comprehended by the receiver of the message. The ultimate goal of a speech intelligibility test is to obtain a measure indicating how much of an incoming speech signal a listener is able to understand in normal conversation using, for example, a particular telephone. Many new technologies such as digital transmissions, speech coders and Internet telephony suffer from audio impairments not present in traditional analog systems, thus increasing the necessity for a reliable speech intelligibility test.

One manner in which speech intelligibility is tested is by testing the relative intelligibility of individual speech sounds. An individual speech sound can be represented by a phonetic symbol (hereinafter, speech sounds will be referred to by the phonetic symbol which represents it. For example, the speech sound represented by the phonetic symbol [t] will simply be referred to as speech sound [t]).

FIG. 2(*a*) is a chart showing phonetic symbols for various international consonant speech sounds, while FIG. 2(*b*) is a chart showing phonetic symbols for various international vowel speech sounds. FIG. 3(*a*), on the other hand, is a chart listing phonetic symbols for various English consonant speech sounds, while FIG. 3(*b*) is a chart listing phonetic symbols for various English vowel speech sounds. Each chart also describes the manner of articulation and place of articulation for each speech sound, as is well known in the prior art and as will be further discussed below. For instance, referring to FIG. 3(*a*), the speech sound [m] is a bilabial (place of articulation) nasal stop (manner of articulation). FIGS. 4(*a*) and 4(*b*) list the consonant and vowel phonetic symbols, respectively, along with words or words that employ the speech sound. These figures, as well as FIG. 5(*a*) which will be introduced and discussed later, are re-printed from P. Lagefoged, *A Course in Phonetics, Harcourt Brace Jovanovich* (1993), which is incorporated by reference herein.

The relative intelligibility of individual speech sounds is commonly tested in a two-item forced choice format, one example of which is illustrated in FIG. 1. In FIG. 1, sound device 10, which can be any device able to convey sound to a listener, transmits stimulus word 12 to test subject 14. After hearing stimulus word 12, test subject 14 will see two response options, 18*a* and 18*b*, appear on word display device 16. Response options 18*a* and 18*b* are words which, as will be further explained later, have pronunciations which are similar to each other. One of the two response options is the English equivalent of stimulus word 12, while the other is not. The task of test subject 14 is to distinguish which of the two response options, 18*a* or 18*b*, was heard, and to indicate his or her selection by using a selection device (not shown).

One prior art test which uses a two-item forced choice format is Voier's Diagnostic Rhyme Test (hereinafter "DRT"). This test is described in W. Voiers, Evaluation of Processed Speech Using the Diagnostic Rhyme Test, *Speech Technology*, Jan/Feb, p.30–39, (1983). The DRT tests subjects using pairs of words (comprising real words, proper names and non-words) that differ by one speech sound. The differing, or contrasting, speech sounds in this test are generated by varying +/− feature values within a theory of perceptual distinctive features, as is well known in the art and as will be described in greater detail below.

As described in M. Kenstowicz and C. Kisseberth, *Generative Phonology, Academic Press* (1979), which is incorporated by reference herein in its entirety, features are units of phonological structure (phonology is the science of speech sounds). A feature system can be either a perceptual feature system or an articulatory feature system. Generally, perceptual feature systems concern the acoustical qualities of a speech sound while articulatory features concern particular human activities, e.g.—lip rounding, tongue positioning, etc., which produce speech sounds when coordinated. These feature systems are described in *Preliminaries to Speech Analysis*, MIT Press, Cambridge Mass.; *The Sound Pattern of English*, Harper & Row, New York; M. Halle, *Phonology*, (1990); D. Osherton and H. Lasnik, *Language*, Volume I, MIT Press, Cambridge Mass.; and A Survey of Distinctive Feature Values, *UCLA Working Papers in Phonetics* 66, pp. 124–150, all of which are incorporated herein in their entirety.

In both types of feature systems, a particular speech sound can be represented by a matrix of [+] or [−] feature values. A particular set of feature values is used to uniquely describe a speech sound and distinguish it from all other speech sounds. FIG. 5(*a*) is a chart showing some of the features required for classifying English speech sounds. For instance, the figure shows that the voicing feature can be classified as [+voice] or [−voice], and lists the speech sounds that have each classification. As another example, to pronounce the English consonant [m] as in make, the velum is lowered to allow air to pass through the nose. Therefore, [m] has a [+] value for the feature [nasal]. The English consonant [b] has almost identical feature values as [m]. However, to pronounce [b] as in bake, the velum is raised, thus preventing air from flowing through the nose. Therefore, [b] has a [−] value for the feature [nasal].

Similarly, FIG. 5(*b*) is a chart showing a feature matrix for various English vowels. For example, for the dorsal feature tenseness, the figure shows speech sounds that are tense having a [+] value and speech sounds that are lax (the opposite of tense) having a [−] value.

Thus, returning to the DRT prior art testing system, DRT generates sets of word pairs to be presented to the test subject as response options, such that, for the contrasting speech sounds, the value of only one perceptual feature for the first word differs from the value of the same perceptual feature for the second word. Specifically, and as is well known in the art, the DRT utilizes six different perceptual features (voicing, nasality, sustention, sibilation, graveness and compactness) which are referred to as perceptual distinctive features, and includes sixteen word pairs representing a [+/−] contrast for each of the six features. However, contrasts generated in this manner do not accurately reflect the consonant inventory of American English. For instance, despite the fact that there exists only three pairs of contrasting speech sounds which fit the above criteria for [nasal] (i.e.—each speech sound of the pair has the same feature values as the other speech sound of the pair except for having an opposite nasality feature value), the DRT tests the [nasal] feature contrasts sixteen times. Furthermore, DRT tests contrasts for consonants only; no vowel contrasts are tested, and consonants are tested only in the initial position in a word.

The DRT, by selecting contrasting speech sounds to test as it does, yields intelligibility test results which may be unreliable. For instance, some contrasts which may be tested are not highly likely to be perceptually confused by a listener, despite the fact that they differ in the +/− values of one of the distinctive perceptual features, e.g.—the sound represented by the phonetic symbol [k] as in back, as compared to the sound represented by the phonetic symbol [tj] as in batch. Similarly, some contrasts which are likely to be perceptually confused by a listener are not tested because they differ in the +/− values of more than one distinctive feature, e.g.—the sound represented by the phonetic symbol [w] as in swim, as compared to the sound represented by the phonetic symbol [l] as in slim.

Another prior art test, which uses a similar method of testing subjects with words which are generated by varying +/− feature values, is van Santen's Minimal Pairs Intelligibility Test (hereinafter "MPI"). This test is described in J. van Santen, Perceptual Experiments for Diagnostic Testing of Text-to-Speech Systems, *Computer Speech and Language* 7, p.49–100, (1993). Like the DRT, the MPI test presents subjects with pairs of words (including numerous multi-syllabic words such as "divergences" and "intransigence") having contrasting speech sounds, generated solely by varying +/− feature values.

Thus, there exists a need for an intelligibility testing system which reliably measures the speech intelligibility of a communication system.

SUMMARY OF THE INVENTION

The present invention, according to one embodiment, comprises a speech intelligibility testing system and method. The invention comprises a sound device for producing a plurality of stimulus words to be heard by a test subject, each of the stimulus words comprising a plurality of speech sounds. The invention also comprises a display means configured to display a set of selectable word pairs corresponding to a set of contrasting speech sounds, whenever a stimulus word is provided to the test subject. Each of the words comprise a real word with a high degree of familiarity to the test subject. The familiarity score of the words is preferably over 4.0 on a 1–7 scale, wherein 1 represents "not familiar" and 7 represents "very familiar". A first word of the word pair corresponds to the stimulus word, while a second word differs from the first word by at least one contrasting speech sound. The invention also comprises means for the test subject to select either of the two words of the word pair after deciding which one of the two words was heard.

In accordance with one embodiment, and as will be explained more fully later, the present invention does not follow any one single theory of distinctive features, as do the methods of the prior art. Instead, the present invention uses novel rules to generate consonant and vowel contrasts to be tested. The rules for generating consonant contrasts are that each obstruent speech sound is contrasted with: 1) all other speech sounds having the same voicing and the same manner of articulation; 2) the speech sound that has the opposite voicing, while having the same place and manner of articulation; 3) the nasal stop at the same place of articulation, irrespective of the voicing; and 4) the corresponding fricative and/or affricate speech sound; and (5) that each approximant speech sound is contrasted with all other approximants. The rules for generating vowel contrasts are that each vowel speech sound is contrasted with: 1) the vowel speech sound which is identical except for tenseness; 2) all other vowel speech sounds with the same backness; and 3) the corresponding vowel speech sound with the opposite backness, and 4) that each lax vowel speech sound is contrasted with the speech sound [ə].

In accordance with another embodiment of the invention, each word of the selectable word pair is a one syllable word that consists of at least three speech sounds, whereby a first speech sound is a consonant speech sound, a second speech sound is a vowel speech sound and a third speech sound is a consonant speech sound, and the intelligibility test of the present invention is employed to test the contrasting speech sounds in either or all of the first, second and third speech sounds of the words.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings in which:

FIGS. 2(*a*) and 2(*b*) are charts that show phonetic symbols for various international consonant and vowel speech sounds, as employed in accordance with one embodiment of the invention;

FIGS. 4(*a*) and 4(*b*) list phonetic symbols for various consonant and vowel speech sounds, respectively, along with words or words that employ the speech sound, in accordance with one embodiment of the invention;

FIG. 5(*a*) is a chart showing some of the features required for classifying English speech sounds, in accordance with one embodiment of the present invention;

FIG. 5(*b*) is a chart showing a feature matrix for various English vowels, in accordance with one embodiment of the present invention;

FIG. 6(*a*) lists various word pairs having consonant contrasts, in accordance with one embodiment of the invention;

FIG. 6(*b*) lists various word pairs having vowel contrasts, in accordance with one embodiment of the invention.

DETAILED DESCRIPTION OF THE INVENTION

In accordance with one embodiment, the present invention is a speech intelligibility testing system that employs a two-item forced choice test format.

Figure 1:
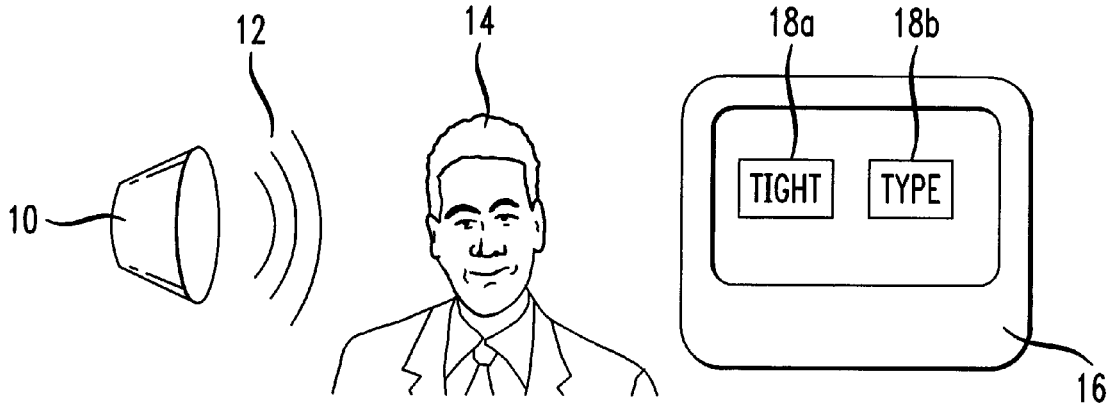
FIG. 1 illustrates a typical two-item forced choice test format, as employed in accordance with one embodiment of the present invention.

As described previously, FIG. 1 illustrates a typical two-item forced choice test format, as employed in one embodiment of the present invention. The purpose of the test is to determine the quality of a sound device by measuring the intelligibility of speech produced by the sound device. In the figure, sound device 10, which can be any device able to convey sound to a listener, produces stimulus word 12 to be heard by test subject 14. For instance, sound device 10 can be a telephone receiving wireless speech signals via a cellular network, or it can be a telephone or speaker receiving a transmission of speech signals via Internet telephony. Additionally, sound device 10 can be a hearing aid device worn by a hearing impaired person. The present invention is not intended to be limited in scope by the type of sound device.

Upon producing stimulus word 12, display means 16 presents a selectable word pair comprising words 18*a* and 18*b*, to test subject 14. One of the two words of the word pair is the equivalent of stimulus word 12, while the other is not. The task of test subject 14 is to distinguish which one of the two words 18*a* or 18*b* was heard, and to indicate his or her selection by using a selection device (not shown). The selection device may be a pair of buttons or keys on a keypad, each button or key associated with one of the presented words, such that a particular word is selected when either of the buttons or keys are pressed. Alternately, in accordance with another embodiment of the invention, test subject 14 may see the word pair displayed on paper and select the word believed to be heard by checking it off or by writing or typing it. Any method by which test subject 14 may see the word pair and choose one of the two words is within the contemplation of the invention.

The present invention, in accordance with one embodiment, employs a set of word pairs (one word of which corresponds to stimulus word 12), to be displayed to test subject 14 in order to determine the quality of a sound device by measuring the intelligibility of the stimulus word 12. The pronunciation of the two words in each word pair differ by a single speech sound. The contrasting speech sounds in each word pair of the present invention, according to one embodiment, are generated in accordance with a specific set of rules, which will be detailed below.

According to one aspect of the present invention, each word of the word pair is a real word. This is contrary to prior art testing systems, which employ non-words and proper names in order to test contrasts for which no real word exists in the English language. For instance, the DRT utilizes real words, proper names (e.g.—"Dan") and non-words (e.g.—"foo") during the test. The problem with using a mixed stimulus set of words such as this is that listeners process real words differently from non-words, as noted in W. Ganong, Phonetic Characterization in Auditory Word Perception, *Journal of Experimental Psychology: Human Perception and Performance*, pp.110–125 (1980), which is incorporated by reference herein.

Similarly, listeners process real words differently from proper names, as noted in D. H. Whalen and E. C. Zsiga, Subjective Familiarity of English Word/Name Homophones, *Behavior Research Methods, Instruments & Computers*, pp.402–408 (1994) and E. Zeichmeister, J. King et al., Ratings of Frequency, Familiarity, Orthographic Distinctiveness and Pronuncibility for 192 Surnames, *Behavior Research Methods and Instrumentation*, pp.531–533 (1975), both of which are incorporated by reference herein. Thus, by utilizing the prior art tests, errors may be introduced into the testing process because a person may be more likely to select a response option recognizable as a real word, rather than a response option recognizable as a non-word or proper name.

Additionally, in accordance with the preferred embodiment, only response option words which have a high degree of familiarity to the average native speaker of the English language are utilized in the test. By contrast, both the prior art DRT and the MPI tests utilize words which are often unfamiliar to the test subject. For instance, the DRT uses words such as "thole", "vill" and "gat", which are typically not familiar to the average native speaker of the English language. Additionally, the MPI test uses numerous multi-syllabic words such as "clamorous", "divergences" and "intransigence", which are also not typically familiar.

If a test subject is presented with a choice between two responses, one familiar and one unfamiliar, he or she may be more likely to choose the familiar response irrespective of the stimulus presented. Furthermore, listeners may make errors on certain items in an intelligibility test because the words presented are unfamiliar, and not because the words are unintelligible. Each of these factors contributes to the unreliability of the prior art testing systems. The use of words that have a high degree of familiarity to the average listener prevents unreliable test results by removing the tendency of a test subject to reject a word merely because he or she is unfamiliar with it, rather than because the stimulus word was unintelligible. This is shown in D. Howes, On the Relation Between the Intelligibility and Frequency of Occurrence of English Words, *Journal of the Acoustical Society of America*, pp. 296–305, (1957); P. Newbigging, The Perceptual Reintegration of Frequent and Infrequent Words, *Canadian Journal of Psychology*, pp. 123–132 (1961); H. Savin, Word-frequency Effect and Errors in the Perception of Speech, *Journal of the Acoustic Society of America*, pp.200–206 (1963); R. Solomon and L. Postman, Frequency of Usage as a Determinant of Recognition Thresholds for Words, *Journal of Experimental Psychology*, pp. 195–201 (1952), all of which are incorporated by reference herein.

Figure 7:
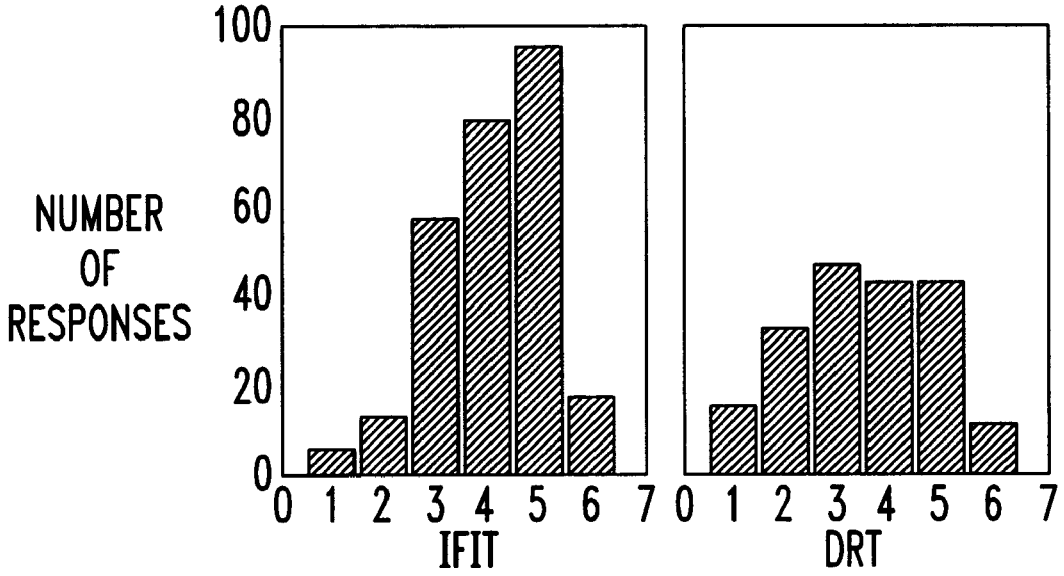
FIG. 7 shows the results of a word familiarity test, conducted to compare the familiarity of the words used in various intelligibility tests, as employed in accordance with one embodiment of the invention.

The words utilized in FIGS. 6(*a*) and 6(*b*), which will be explained more fully later, arc the preferred word pairs to be employed in the test. These words are more familiar to the average test subject than the words used in either the DRT or MPI tests. This is illustrated in FIG. 7, which shows the results of a word familiarity test, conducted to compare the familiarity of the words in each test to the average person. Each word was rated by the test subjects on a score of 1 (not familiar at all) to 7 (very familiar). The average score for the words used in the DRT was 3.97, while the average score for the words shown in FIGS. 6(*a*) and 6(*b*), designated in the figure as "IFIT" for "Intelligibility of Familiar Items Test", was 4.63. The average familiarity scores for the two tests were shown to be highly significantly different by a t-test for differences between the means ($t(456)=5.88, p<0.0001$), as can be found in S. Hura, Speech Intelligibility Testing for New Technologies, *Proceedings of the 5th International Conference on Spoken Language Processing*. These familiarity scores correlate highly with those reported in M. Coltheart, The MRC Psycholinguistic Database, *Quarterly Journal of Experimental Psychology: Human Experimental Psychology*, pp.497–505 (1981), which reports standardized word familiarity, frequency and other measures, and which is incorporated by reference herein.

As will be discussed further below, the present invention, in accordance with one embodiment, employs rules that are formulated according to the place of articulation, manner of articulation and voicing of consonants and tongue height, tongue backness, lip rounding and tenseness of vowels as shown in FIGS. 2(*a*) and 2(*b*). FIGS. 2(*a*) and 2(*b*) show the consonant and vowel charts of the International Phonetic Association (IPA). Unlike distinctive features theories, which are controversial and under debate by scholars, the IPA charts are widely agreed upon in the field. The IPA charts represent the general properties of production of speech sounds (i.e.—the place of articulation, the manner of articulation, etc.), and as such show logical groupings or natural classes of sounds. For example, all consonant sounds falling in a particular row of FIG. 2(*a*) share a place of articulation.

As stated previously, a specific set of rules are employed for generating consonant contrasts used in generating word pairs, and another specific set of rules are employed for generating vowel contrasts used in generating word pairs. Generally, the contrasting speech sounds included in the test are those contrasts likely to be confused by the listener.

When the testing is completed, the number of mistaken selections by the listener can be tabulated by a scoring device, and a measure of the intelligibility of the system is produced. Generally, a communication system for which a listener mistakenly selects a word different from the stimulus word has a lower quality than a communication system for which a listener correctly selects a word corresponding to the stimulus word.

The rules for generating consonant contrasts are as follows: each obstruent speech sound (obstruent speech sounds include oral plosives, fricatives and affricates, as shown in FIG. 2(*a*)) is contrasted with: 1) all other speech sounds having the same voicing and the same manner of articulation; 2) the speech sound that has the opposite voicing, while having the same place and manner of articulation; 3) the nasal stop at the same place of articulation, irrespective of the voicing; and 4) the corresponding fricative and/or affricate speech sound. The rule further requires that each approximant speech sound (as shown in FIG. 2(*a*)) is contrasted with all other approximants.

Figure 3A:
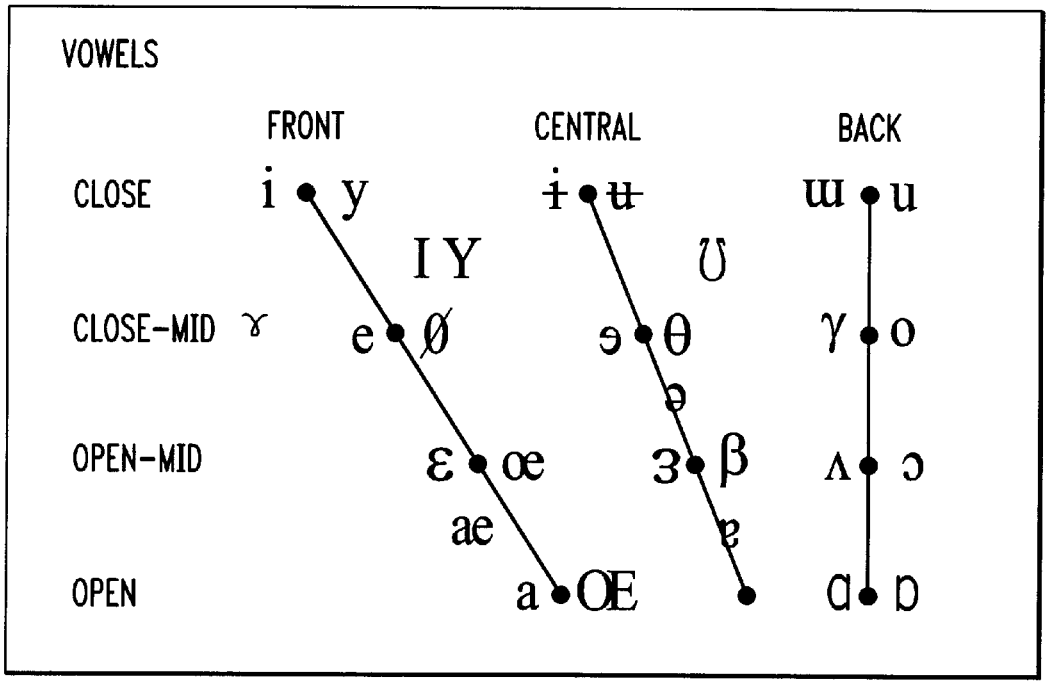
FIG. 3(*a*) and 3(*b*) are charts listing phonetic symbols for various English consonant and vowel speech sounds, in accordance with one embodiment of the present invention.
Figure 3B:
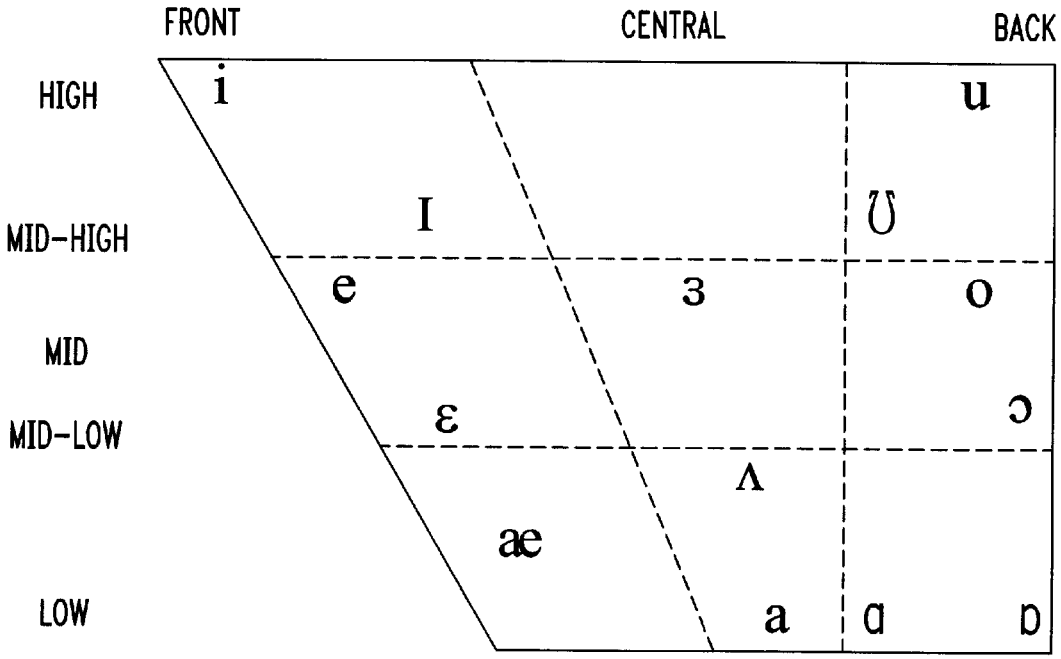

For example, by referring to FIGS. 2(*a*) and 3(*a*), it can be seen that the speech sound [b] can be described as a voiced bilabial stop consonant. FIG. 3(*a*) shows that there are two other voiced stop consonants in English, namely [d] and [g]. Therefore, under item (1) of the rule stated above, speech sounds [b], [d] and [g] are all contrasted during the speech intelligibility test by presenting word pairs to the test subject that are identical in sound except for a single speech sound having these contrasts. As a further example, it can be seen that speech sound [t] has the same place and manner of articulation as speech sound [d], but has opposite voicing. Under item (2) of the rule stated above, speech sounds [d] and [t] are contrasted during the speech intelligibility test by presenting word pairs to the test subject that are identical in sound except for a single speech sound having this contrast.

The rules for generating vowel contrasts are as follows: each vowel speech sound is contrasted with: 1) the vowel speech sound which is identical except for tenseness; 2) all other vowel speech sounds that have the same backness; and 3) the corresponding vowel speech sound that has the opposite backness. Additionally, each lax vowel speech sound is contrasted with the speech sound [ə].

For example, by referring to FIG. 5(*b*), it can be seen that vowel speech sound [u] is tense. The vowel speech sound [ʊ] is the same as vowel speech sound [u], but is lax. Therefore, under item (1) of the rule for vowel contrasts stated above, speech sounds [u] and [ʊ] are contrasted during the speech intelligibility test by presenting word pairs to the test subject that are identical in sound except for a single speech sound having this vowel contrast. As a further example, it can be seen that vowel speech sound [ʊ] has the same feature values as vowel speech sound [I], but with opposite backness. Under item (3) of the rule for vowel contrasts stated above, speech sounds [ʊ] and [u] are contrasted during the speech intelligibility test by presenting word pairs to the test subject that are identical in sound except for a single speech sound having this contrast.

In accordance with one embodiment, the present invention utilizes word pairs, having consonant and vowel contrasts that proscribe to the rules stated above, such that each word of the word pair is mono-syllabic and consists of at least three speech sounds, wherein the first speech sound is a consonant speech sound, the second speech sound is a vowel speech sound and the third speech sound is another consonant speech sound. FIG. 6(*a*) lists various word pairs, in accordance with one embodiment of the invention, whereby the words of each word pair have one syllable and a consonant-vowel-consonant speech sound arrangement. The left column of the figure lists the consonant contrasts that are identified by the rules for generating consonant contrasts stated above. The next four columns, under the heading "Initial Position", list corresponding word pairs (and their phonetic transcriptions) that contain the identified consonant contrast in their first speech sound position. The four columns to the right, under the heading "Final Position", list corresponding word pairs (and their phonetic transcriptions) that contain the identified consonant contrast in their final speech sound position.

For example, the speech sounds [b] and [d] were identified by item (1) of the rules for generating consonant contrasts. The contrast, identified by the symbol [b/d], can be found in the left column of FIG. 6(*a*). The word pair corresponding to this consonant contrast, which tests the contrast in the initial position, is "buys" and "dies". Source device 10 transmits either of these words as stimulus word 12 to test subject 14. According to one embodiment, both of these words are displayed on display device 16 as response options 18*a* and 18*b*, and test subject 14 selects which of the response options he or she heard.

Additionally, the word pair corresponding to this consonant contrast, which tests the contrast in the final position, is "sob" and "sod". As above, source device 10 transmits either of these words as stimulus word 12 to test subject 14, both words are displayed on display device 16 as response options 18*a* and 18*b*, and test subject 14 selects which of the response options he or she heard.

FIG. 6(*b*) also lists various word pairs, in accordance with one embodiment of the invention, whereby the words of each word pair have one syllable and a consonant-vowelconsonant speech sound arrangement. In this case, however, the left column of the table lists the vowel contrasts that are identified by the rules for generating vowel contrasts, as stated above. The next four columns list corresponding word pairs (and their phonetic transcriptions) that contain the identified vowel contrast.

For example, the vowel speech sounds [u] and [ʊ] were identified by item (1) of the rules for generating vowel contrasts. The contrast, identified by the symbol [u/ʊ], can be found in the left column of FIG. 6(*b*). The word pair corresponding to this vowel contrast is "pull" and "pool". Source device 10 transmits either of these words as stimulus word 12 to test subject 14. According to one embodiment, both of these words are displayed on display device 16 as response options 18*a* and 18*b*, and test subject 14 selects which of the response options he or she heard.

Additionally, the vowel speech sounds [ʊ] and [I] were identified by item (3) of the rules for generating vowel contrasts. The contrast, identified by the symbol [I/ʊ], can also be found in the left column of FIG. 6(*b*). The word pair corresponding to this vowel contrast, according to this embodiment, is "pit" and "put". Once again, source device 10 transmits either of these words as stimulus word 12 to test subject 14, both are displayed on display device 16 as response options 18*a* and 18*b*, and test subject 14 selects which of the response options he or she heard.

It should be noted that the word pairs shown in FIGS. 6(*a*) and 6(*b*) are merely examples of word pairs which could be employed in accordance with one embodiment of the invention. There are typically numerous variations of words by which a contrast can be tested. For instance, in FIGS. 6(*a*), the consonant contrast [p/b] can be tested in the initial position with word pairs such as "pig/big", "pail/bail" or "pit/bit". Thus, the present invention is not intended to be limited in scope only to the actual words shown in FIGS. 6(*a*) and 6(*b*).

In still another embodiment, the words employed in the present invention are not English words but rather real words of a foreign language, with a high degree of familiarity to a native speaker of the foreign language. In this embodiment, the present invention is employed to determine the quality of a sound device by non-English speaking persons, or to test phonetic speech sounds that are not used in the English language.

While only certain features of the invention have been illustrated and described herein, many modifications, substitutions, changes or equivalents will now occur to those skilled in the art. It is therefore, to be understood that the appended claims are intended to cover all such modifications and changes that fall within the true spirit of the invention.

I claim:

1. A speech intelligibility testing system, comprising:

a sound device for producing a plurality of stimulus words to be heard by a test subject, each of said plurality of stimulus words comprising a plurality of speech sounds;

a display means, configured to display to said test subject a set of selectable word pairs corresponding to a set of contrasting speech sounds whenever a stimulus word is provided to said test subject, each of said words comprising a real word with a high degree of familiarity, a first word of said word pair corresponding to said stimulus word and a second word of said word pair differing from said first word by at least one of said set of contrasting speech sounds; and means for said test subject to select one word of said word pair upon deciding which one of said two words was heard.

2. The system of claim 1, wherein said set of response option words has an average word familiarity of not less than 4.00.

3. The system of claim 1, wherein said display means comprises a computer screen.

4. The system of claim 1, wherein said sound device is a wireless telephone.

5. The system of claim 1, wherein said sound device is an Internet telephone.

6. A speech intelligibility testing system, comprising:

a sound device for producing a plurality of stimulus words to be heard by a test subject, each of said plurality of stimulus words comprising a plurality of speech sounds;

a display means, configured to display to said test subject a set of selectable word pairs corresponding to a set of contrasting speech sounds whenever a stimulus word is provided to said test subject, each of said words comprising a real word, said set of contrasting speech sounds comprises consonant contrasts and vowel contrasts, a first word of said word pair corresponding to said stimulus word and a second word of said word pair differing from said first word by at least one of said set of contrasting speech sounds; and means for said test subject to select one word of said word pair upon deciding which one of said two words was heard.

7. The system according to claim 6, wherein said consonant contrasts comprise a pair of consonant speech sounds, wherein each of an obstruent speech sounds is paired with all other speech sounds having a same voicing and same manner of articulation.

8. The system according to claim 6, wherein said consonant contrasts comprise a pair of consonant speech sounds, wherein each of an obstruent consonant speech sound is paired with a speech sound having an opposite voicing, while having a same place and manner of articulation.

9. The system according to claim 6, wherein said consonant contrasts comprise a pair of consonant speech sounds, wherein each of an obstruent consonant speech sound is paired with a speech sound having an opposite nasality, irrespective of the voicing.

10. The system according to claim 6, wherein said consonant contrasts comprise a pair of consonant speech sounds, wherein each of an obstruent consonant speech sound is paired with a corresponding fricative and affricate speech sound.

11. The system according to claim 6, wherein said consonant contrasts comprise a pair of consonant speech sounds, wherein each of an approximant speech sound is paired with all other approximant speech sounds.

12. The system according to claim 6, wherein said vowel contrasts comprise a pair of vowel speech sounds, wherein each vowel speech sound is paired with a vowel speech sound having an opposite tenseness.

13. The system according to claim 6, wherein said vowel contrasts comprise a pair of vowel speech sounds, wherein each vowel speech sound is paired with all other vowel speech sounds that have a same backness.

14. The system according to claim 6, wherein said vowel contrasts comprise a pair of vowel speech sounds, wherein each vowel speech sound is paired with a corresponding vowel speech sound that has an opposite backness.

15. The system according to claim 6, wherein said vowel contrasts comprise a pair of vowel speech sounds, wherein each of a lax vowel speech sound is paired with a speech sound represented by the phonetic symbol [ə].

16. The system according to claim 1, said contrasting speech sounds selected from a group of consonant contrasts consisting of: [p/t], [p/k], [p/b], [p/m], [p/f], [t/k], [t/d], [t/n], [t/s], [t/θ], [t/tʃ], [k/g], [k/ŋ], [k/ʃ], [b/d], [b/g], [b/m], [b/v], [d/g], [d/n], [d/z], [d/ð], [d/dʒ], [g/ŋ], [g/ʒ], [f/θ], [f/s], [f/ʃ], [f/h], [f/v], [f/m], [θ/s], [θ/ʃ], [θ/h], [θ/ð], [θ/n], [s/ʃ], [s/h], [s/z], [s/n], [ʃ/h], [ʃ/ŋ], [ʃ/ʒ], [ʃ/ʧ], [v/ð], [v/z], [v/ʒ], [v/m], [ð/z], [ð/ʒ], [ð/n], [z/ʒ], [z/v], [ʒ/ŋ], [ʒ/ʤ], [m/n], [m/ŋ], [n/ŋ], [ɹ/l], [ɹ/w], [ɹ/j], [l/w], [l/j], [w/y], [ʧ/ʤ].

17. The system according to claim 1, said contrasting speech sounds selected from a group of vowel contrasts consisting of: [i/I], [i/u], [i/eI], [i/ɛ], [i/æ], [I/ʊ], [I/ə], [I/ɛ], [I/æ], [eI/ɛ], [eI/oʊ], [eI/æ], [ɛ/ɔ], [ɛ/ə], [ɛ/æ], [æ/ɑ], [æ/ə], [ɑ/ə], [ɔ/ɑ], [ɔ/ə], [oʊ/ɑ], [oʊ/ɑ], [ʊ/ə], [ʊ/oʊ], [ʊ/ɔ], [ʊ/ɑ], [u/ʊ], [u/oʊ], [u/ɔ], [u/ɑ].

18. The system according to claim 1, wherein each word consists of three speech sounds, whereby a first speech sound is a consonant speech sound, a second speech sound is a vowel speech sound and a third speech sound is a consonant speech sound.

19. The system according to claim 18, wherein said contrasting speech sounds is tested in said first speech sound of said words.

20. The system according to claim 19, said word pairs selected from the group consisting of: peach/teach, pave/cave, pad/bad, paid/maid, pays/phase, take/cake, tuck/duck, toes/nose, tag/sag, tick/thick, top/chop, cash/gash, keep/sheep, buys/dies, boat/goat, bake/make, bet/vet, daze/gaze, deed/need, doom/zoom, doze/those, debt/jet, fought/thought, food/sued, feet/sheet, fill/hill, fan/van, fast/mast, thighs/size, thin/shin, third/heard, thumb/numb, sift/shift, such/hutch, sip/zip, sight/night, share/hair, ship/chip, vat/that, veal/zeal, veil/mail, then/zen, these/knees, zoos/news, mood/nude, rash/lash, rest/west, rack/yak, let/wet, luck/yuck, woke/yoke, and cheer/jeer.

21. The system according to claim 18, wherein said contrasting speech sound is tested in said second speech sound of said words.

22. The system according to claim 21, said word pairs selected from the group consisting of: bead/bid, seep/soup, peace/pace, neat/net, beak/back, pit/put, mist/must, give/gave, sit/set, lift/laughed, rake/wreck, cape/cope, lake/lack, well/wall, beg/bug, guess/gas, cab/cob, cat/cut, shot/shut, caught/cot, bought/but, note/naught, soak/sock, book/buck, cook/coke, could/cawed, push/posh, pull/pool, ruse/rose, suit/sought, and duke/dock.

23. The system according to claim 18, wherein said contrasting speech sound is tested in said third speech sound of said words.

24. The system according to claim 23, said word pairs selected from the group consisting of: type/tight, shop/shock, lap/lab, hope/home, wipe/wife, seat/seek, fate/fade, fit/fin, kit/kiss, boot/booth, pout/pouch, pick/pig, sick/sing, walk/wash, sob/sod, job/jog, tube/tomb, dub/dove, did/dig, dude/dune, pawed/pause, bade/bathe, head/hedge, rag/rang, deaf/death, buff/bus, rough/rush, leaf/leave, thief/theme, path/pass, with/wish, teeth/teethe, both/bone, mess/mesh, hiss/his, vice/vine, bash/bang, mash/match, live/lithe, have/has, cove/comb, lathe/lays, soothe/soon, lose/luge, tease/teen, term/turn, some/sung, win/wing, tire/tile, perch/purge.

25. The system according to claim 1, wherein said words comprise foreign language words.

26. A method for testing speech intelligibility, comprising the steps of:

producing a plurality of stimulus words with a sound device to be heard by a test subject, each of said plurality of stimulus words comprising a plurality of speech sounds;

displaying to said test subject a set of selectable word pairs corresponding to a set of contrasting speech sounds whenever a stimulus word is transmitted to said test subject, a first word of said word pair corresponding to said stimulus word, and a second word of said word pair differing from said first word by at least one of said set of contrasting speech sounds, each said word comprising a real word with a high degree of familiarity; and selecting, by said test subject, either word of said word pair upon deciding which of said two words was heard.

27. The method of claim 26, wherein said set of words has an average word familiarity of not less than 4.00.

28. A method for testing speech intelligibility, comprising the steps of:

producing a plurality of stimulus words with a sound device to be heard by a test subject, each of said plurality of stimulus words comprising a plurality of speech sounds;

displaying to said test subject a set of selectable word pairs corresponding to a set of contrasting speech sounds whenever a stimulus word is transmitted to said test subject, said set of contrasting speech sounds comprising consonant contrasts and vowel contrasts, a first word of said word pair corresponding to said stimulus word, and a second word of said word pair differing from said first word by at least one of said set of contrasting speech sounds, each said word comprising a real word; and selecting, by said test subject, either word of said word pair upon deciding which of said two words was heard.

29. The method according to claim 28, wherein said consonant contrasts comprise a pair of consonant speech sounds, wherein each of an obstruent consonant speech sound is paired with all other speech sounds having a same voicing and same manner of articulation.

30. The method according to claim 28, wherein said consonant contrasts comprise a pair of consonant speech sounds, wherein each of an obstruent consonant speech sound is paired with a speech sound having an opposite voicing, while having a same place and manner of articulation.

31. The method according to claim 28, wherein said consonant contrasts comprise a pair of consonant speech sounds, wherein each of an obstruent consonant speech sound is paired with a speech sound having an opposite nasality, irrespective of the voicing.

32. The method according to claim 28, wherein said consonant contrasts comprise a pair of consonant speech sounds, wherein each of an obstruent consonant speech sound is paired with a corresponding fricative and affricate speech sound.

33. The method according to claim 28, wherein said consonant contrasts comprise a pair of consonant speech sounds, wherein each of an approximant speech sound is paired with all other approximant speech sounds.

34. The method according to claim 28, wherein said vowel contrasts comprise a pair of vowel speech sounds, wherein each vowel speech sound is paired with a vowel speech sound except having an opposite tenseness.

35. The method according to claim 28, wherein said vowel contrasts comprise a pair of vowel speech sounds, wherein each vowel speech sound is paired with all other vowel speech sounds that have a same backness.

36. The method according to claim 28, wherein said vowel contrasts comprise a pair of vowel speech sounds, wherein each of a lax vowel speech sound is paired with a corresponding vowel speech sound that has an opposite backness.

37. The method according to claim 28, wherein said vowel contrasts comprise a pair of vowel speech sounds, wherein each of a lax vowel speech sound is paired with a speech sound represented by the phonetic symbol [ə].

38. The method according to claim 26, said contrasting speech sounds selected from the group of consonant contrasts consisting of: [p/t], [p/k], [p/b], [p/m], [p/f], [t/k], [t/d], [t/n], [t/s], [t/θ], [t/tʃ], [k/g], [k/ŋ], [k/ʃ], [b/d], [b/g], [b/m], [b/v], [d/g], [d/n], [d/z], [d/ð], [d/dʒ], [g/ŋ], [g/ʒ], [f/θ], [f/s], [f/ʃ], [f/h], [f/v], [f/m], [θ/s], [θ/ʃ], [θ/h], [θ/ð], [θ/n], [s/ʃ], [s/h], [s/z], [s/n], [ʃ/h], [ʃ/ŋ], [ʃ/ʒ], [ʃ/ʧ], [v/ð], [v/z], [v/ʒ], [v/m], [ð/z], [ð/ʒ], [ð/n], [z/ʒ], [z/v], [ʒ/ŋ], [ʒ/ʤ], [m/n], [m/ŋ], [n/ŋ], [ɹ/l], [ɹ/w], [ɹ/j], [l/w], [l/j], [w/y], [ʧ/ʤ].

39. The method according to claim 26, said contrasting speech sounds selected from the group of vowel contrasts consisting of: [i/I], [i/u], [i/eI], [i/ϵ], [i/æ], [I/ʊ], [I/ə], [I/ϵ], [I/æ], [eI/ϵ], [eI/oʊ], [eI/æ], [ϵ/ɔ], [ϵ/ə], [ϵ/æ], [æ/ɑ], [æ/ə], [ɑ/ə], [ɔ/ɑ], [ɔ/ə], [oʊ/ɑ], [oʊ/ɑ], [ʊ/ə], [ʊ/oʊ], [ʊ/ɔ], [ʊ/ɑ], [u/ʊ], [u/oʊ], [u/ɔ], [u/ɑ].

40. The method according to claim 26, wherein each word consists of three speech sounds, wherein a first speech sound is a consonant speech sound, a second speech sound is a vowel speech sound and a third speech sound is a consonant speech sound.

41. The method according to claim 40, said method further comprising the step of testing said contrasting speech sounds in said first speech sound of said words.

42. The method according to claim 41, said word pairs selected from the group consisting of: peach/teach, pave/cave, pad/bad, paid/maid, pays/phase, take/cake, tuck/duck, toes/nose, tag/sag, tick/thick, top/chop, cash/gash, keep/sheep, buys/dies, boat/goat, bake/make, bet/vet, daze/gaze, deed/need, doom/zoom, doze/those, debt/jet, fought/thought, food/sued, feet/sheet, fill/hill, fan/van, fast/mast, thighs/size, thin/shin, third/heard, thumb/numb, sift/shift, such/hutch, sip/zip, sight/night, share/hair, ship/chip, vat/that, veal/zeal, veil/mail, then/zen, these/knees, zoos/news, mood/nude, rash/lash, rest/west, rack/yak, let/wet, luck/yuck, woke/yoke, and cheer/jeer.

43. The method according to claim 40, said method further comprising the step of testing said contrasting speech sounds in said second speech sound of said words.

44. The method according to claim 43, said word pairs selected from the group consisting of: bead/bid, seep/soup, peace/pace, ncat/net, beak/back, pit/put, mist/must, give/gave, sit/set, lift/laughed, rake/wreck, cape/cope, lake/lack, well/wall, beg/bug, guess/gas, cab/cob, cat/cut, shot/shut, caught/cot, bought/but, note/naught, soak/sock, book/buck, cook/coke, could/cawed, push/posh, pulupool, ruse/rose, suit/sought, and duke/dock.

45. The method according to claim 40, said method further comprising the step of testing said contrasting speech sound in said third speech sound of said words.

46. The method according to claim 45, said word pairs selected from the group consisting of: type/tight, shop/shock, lap/lab, hope/home, wipe/wife, seat/seek, fate/fade, fit/fin, kit/kiss, boot/booth, pout/pouch, pick/pig, sick/sing, walk/wash, sob/sod, job/jog, tube/tomb, dub/dove, did/dig, dude/dune, pawed/pause, bade/bathe, head/hedge, rag/rang, deaf/death, buff/bus, rough/rush, leaf/leave, thief/theme, path/pass, with/wish, teeth/teethe, both/bone, mess/mesh, hiss/his, vice/vine, bash/bang, mash/match, live/lithe, have/has, cove/comb, lathe/lays, soothe/soon, lose/luge, tease/teen, term/turn, some/sung, win/wing, tire/tile, perch/purge.

47. The method according to claim 26, wherein said words are foreign language words.

* * * * *